United States Patent [19]

Dixon

[11] 4,295,242

[45] Oct. 20, 1981

[54] CORNER BEADING CLEANER

[76] Inventor: William Dixon, Rte. #2, Box 2009, Circle Dr., Browns Mills, N.J. 08015

[21] Appl. No.: 146,712

[22] Filed: May 5, 1980

[51] Int. Cl.[3] ..... B05C 17/10

[52] U.S. Cl. ..... 15/235.7; 15/236 R; 30/171

[58] Field of Search ..... 15/235.7, 236; 30/171

[56] References Cited

U.S. PATENT DOCUMENTS

| | | | |
|---|---|---|---|
| 515,890 | 3/1894 | Walrath | 15/235.7 |
| 1,857,237 | 5/1932 | Chiocchio | 15/235.7 X |
| 2,280,778 | 4/1942 | Andersen | 15/236 R X |
| 2,556,797 | 6/1951 | Carlson | 15/236 R |
| 3,895,439 | 7/1975 | Ehrenberg et al. | 30/171 |

*Primary Examiner*—Chris K. Moore

*Attorney, Agent, or Firm*—John J. Kane; Frederick A. Zoda; Albert Sperry

[57] ABSTRACT

A corner beading cleaner usable to shape hardened joint compound adjacent convex corner beadings including a body which defines a handle area and a lip area extending outwardly from the handle area, the lip having a securement device attached thereto being adapted to detachably secure a tool means with respect to the handle area, the tool means including two blade edges defining a blade cutting surface of less than 90 degrees in order to smooth the joint compound between the bead of the convex beading member and the surrounding joint compound area, the corner beading cleaner securement device including a clamping plate extending laterally across the lip such as to secure the tool between the clamping plate and the lip when the clamping plate is secured with respect to the lip, the clamping plate further possibly including ears extending downwardly from the lateral sides thereof to prevent lateral dislodgement of the tool.

10 Claims, 3 Drawing Figures

CORNER BEADING CLEANER

BACKGROUND OF THE INVENTION

1. Field of the Invention

The present invention deals with the field of art of tools usable in the application and shaping of joint compound as is usually utilized in dry plaster wall interior construction. Many such tools, particularly hand tools, are in existence for applying tape over joint cement, for applying joint cement then over the tape, for applying corner beading to the convex corner formed by dry wall and other similar applications.

The present invention pertains to these tools by providing a means for shaping of joint compound immediately adjacent the apex of such convex dry wall corners. Normally a piece of corner beading is placed along this protruding corner. The corner beading normally includes a bead or enlarged protruding section at the tip such that joint cement may be generally and roughly placed on top of the laterally and rearwardly extending flanges of the beading to provide a smooth surface in contour with the surrounding compounded surfaces. The present invention provides a hand tool for easily and quickly smoothing the surface adjacent this protruding bead edge by contouring the joint compound in one motion.

2. Description of the Prior Art

The smoothing of hardened joint compound at the seams and corners of dry wall plaster boards is normally performed with a putty knife. Such knives are presently available in widths from 1 to 10 inches.

When a putty knife is used to contour the hardened joint cement adjacent a corner beading member it is necessary to make at least three strokes along the surface such that, firstly, the one side of the beading may be smoothed and, secondly, such that the other side of the beading can be smoothed, and, thirdly, such that the apex of the corner can be smoothed. This is a three-step process which is time consuming and often results in an edge which is not as smooth as is possible by the one stroke action when using the present invention.

SUMMARY OF THE INVENTION

The corner beading member of the present invention includes a body section having a handle means adapted to be grasped by the user and a lip extending outwardly from the handle means normally at an angle of approximately 135 degrees with respect thereto. This beading cleaner is particularly adapted to shape or contour dry joint compound adjacent convex corner beadings.

The corner beading cleaner further includes a tool which is secured in a detachable fashion to the lip area of the body section. The tool includes two outwardly extending blade edges forming an angle of 80 to 90 degrees with respect to one another on one end of the tool and a similar construction on the opposite end of the tool. In this manner the tool may be detached from the lip means and the tool itself can be turned around and reattached by the securement means to the lip such that a new cutting surface is usable.

The means of securing the tool means to the lip is preferably by way of a clamping plate which extends laterally across the lip and is adapted to receive the tool between this clamping plate and the lip to thereby hold the tool fixedly in place with respect to the handle portion of the body. A threaded member such as a screw or the like preferably extends through the clamping plate to thereby detachably secure the clamping plate to the lip means and hold the tool fixedly in place during usage. The clamping plate may further include ear means extending downwardly therefrom on opposite lateral sides of the clamping plate to prevent lateral dislodgement of the tool from between the clamping plate and the lip.

It is also preferable that the handle means and the lip means are integral with respect to one another in that they form one continuous member which itself is bent in order to form the angle of approximately 135 degrees between the lip and the handle.

It is an object of the present invention to provide a corner beading cleaner for shaping hardened joint compound cement adjacent convex corner beading members.

It is an object of the present invention to provide a corner beading cleaner for shaping joint cement adjacent convex corners which includes a handle means which is approximately at an angle of 135 degrees with respect to the shaping tool to facilitate usage and minimize worker fatigue.

It is an object of the present invention to provide a corner beading cleaner for shaping joint compound corners which includes a detachable shaping tool.

It is an object of the present invention to provide a corner beading cleaner for shaping joint compound corners including a reversable tool means to provide two shaping blades for each single tool means.

It is an object of the present invention to provide a corner beading cleaner for shaping joint compounds which includes a clamping plate for fixedly securing the tool with respect to the handle during usage.

It is an object of the present invention to provide a corner beading cleaner which is extremely simple and quick in usage.

It is an object of the present invention to provide a corner beading cleaner which is usable to contour hardened joint compound adjacent a convex corner beading by using a single stroke only.

It is an object of the present invention to provide a corner beading cleaner which is inexpensive in cost and which includes blades which are inexpensive to replace.

It is an object of the present invention to provide a corner beading cleaner having a clamping plate including ear means extending downwardly and laterally therefrom to prevent lateral dislodgement of the tool means during usage thereof.

It is an object of the present invention to provide a corner beading cleaner being particularly usable to shape hardened joint compound adjacent convex corner beadings which eliminates the need for using three strokes as normally used when standard putty knives are used to clean beads.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
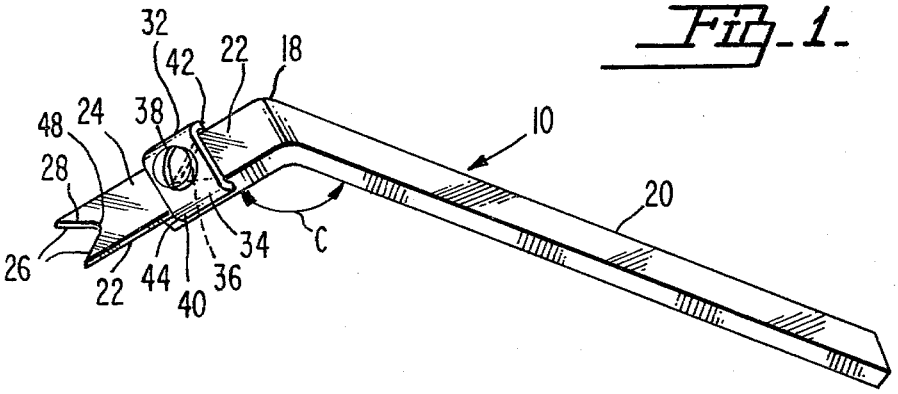
FIG. 1 is a perspective view of an embodiment of the corner beading cleaner of the present invention.
Figure 3:
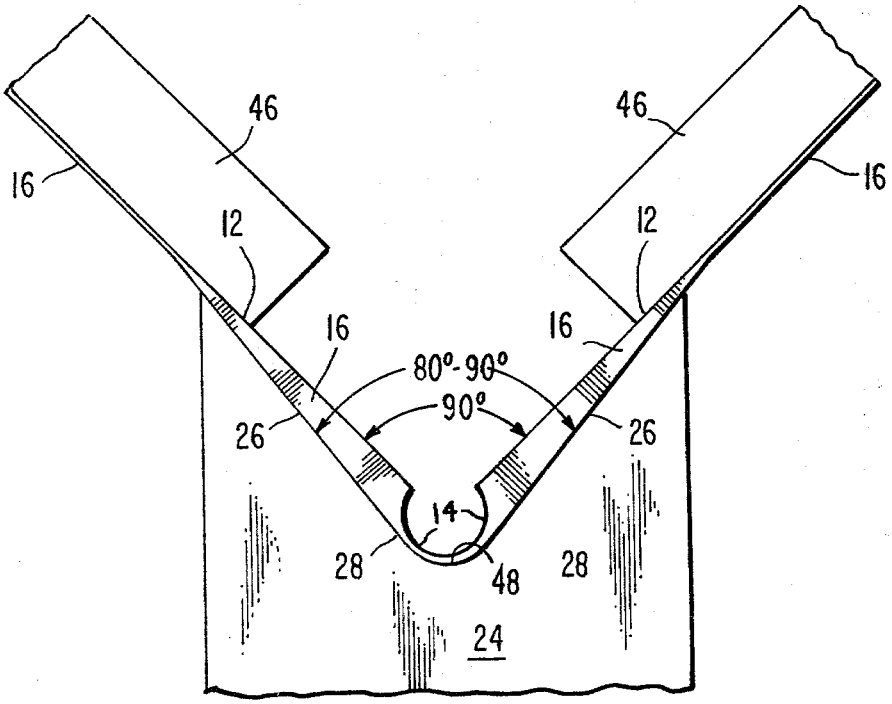
FIG. 3 is a top cross-sectional view of an embodiment of the corner beading cleaner of the present invention shown in operation shaping joint compound adjacent a convex corner beading.

An embodiment of the corner beading cleaner 10 of the present invention as shown in FIG. 1. This cleaner 10 is particularly usable in the cleaning of convex corner beading members 12 as best shown in FIG. 3. Such beading members 12 include a forwardly protruding generally circular bead 15 which must be filled in on the lateral edges with joint compound 16 in order to provide a smoothly contoured convex corner with respect to the surrounding wall board 46.

Figure 2:
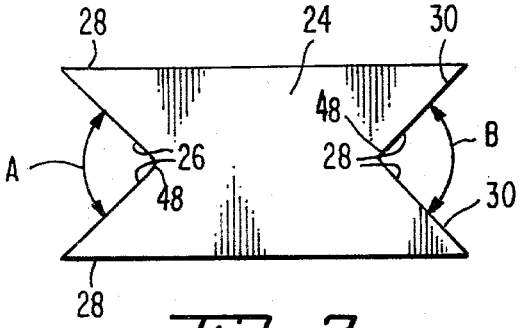
FIG. 2 is a top plan view of an embodiment of a tool means of the present invention.

In order to provide a hand tool to perform this function the corner beading cleaner 10 should include a body section 18 which itself further includes a handle means 20 and a lip means 22 which are at an angle of approximately 135 degrees with respect to one another. This angle is shown as angle C in FIG. 1. A tool means 24 is detachably secured to the lip means 22 of the body section 18. Each tool means includes a first blade edges 26 and a second blade edges 30. Normally as shown in FIG. 2 the first blade edges will be on one end of the tool and the second blade edges will be on the other end of the tool. Each of the blade edges defines a cutting surface 28 which forms an acute angle of less than 90 degrees with respect to one another. Preferably this angle is shown in FIG. 2 as angle A for the first blade edges 26 and for the second blade edges 28 as angle B.

Preferably first blade edges 26 will include a first arcuate concave section at the intersecting point between each of the first blade edges 26. In this manner this arcuate section will generally form a contour similar to the convex contour of normal bead 14. Similarly, the second blade edges 30 will define an arcuate concave surface 48 at the intersection between each blade edge 30. In this manner this cutting edge when used will also assume the approximate contour of the convex bead 14.

The tool means 24 must be detachably secured to the lip means 22 by a securement means 32. This securement means will preferably take the form of a clamping plate 34 which extends laterally across the lip means 22 of the body section 18 and is adapted to receive the tool means 24 between the clamping plate and the lip means to thereby fixedly hold the tool means in place with respect to the handle 20. Preferably a threaded member 36 such as a screw or the like will extend downwardly through a hole in the clamping plate and will be mated with a threaded aperture 38 in the lip means to thereby provide a means for fixedly securing the clamping plate 34, the tool means 24 and the lip means 22 with respect to one another.

In order to further secure the tool means 24 in place with respect to the handle 20 which will be gripped by the user, the clamping plate 34 may include a first ear means 40 and second ear means 42 extending downwardly from the opposite lateral sides 44 of the clamping plate. In this manner the first and second ear means 40 and 42 will prevent lateral dislodgement of tool means 24 from between the clamping plate 34 and the lip means 22.

In operation the user will grasp the handle 20 and guide the blade edges downwardly along the protruding bead 14. Actually with the mud roughly smeared along the protruding corner it will be most advisable to place the tool 24 in direct contact with the bead 14 and urge one downward smooth stroke. As shown in FIG. 3 this downward smooth stroke will cause the cement to be smoothed on each side of the bead 14 into a smooth contour with that joint compound 16 which has already been smoothed in the areas adjacent to the corner. As shown in this figure each wall board section 46 will normally be secured to the corner beading by way of nails or the like in order to form the roughened corner structure. Then the joint compound will be roughly placed in the area of the corner beading such that the corner beading can be smoothed by utilizing the tool means 24 of the present invention to thereby provide a completely contoured and smooth surface from the point of the bead to the joint compound 16 in the areas further away from the corner than the terminating edge of the corner beading member itself.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A corner beading cleaner, being particularly adaptable to shape hardened joint compound adjacent convex corner beadings, said corner beading cleaner comprising:

(a) a body section further including;
  (1) a handle means adapted to be grasped by the user; and
  (2) a lip means extending outwardly from said handle means; and (b) a tool means detachably secured to said lip means of said body section, said tool means including two first blade edges extending outwardly therefrom at an angle of less than 90 degrees with respect to one another to form a cutting surface of less than 90 degrees, said tool means further including two second blade edges extending outwardly therefrom at an angle of less than 90 degrees with respect to one another to form a cutting surface of less than 90 degrees; and (c) a securement means adapted to detachably secure said tool means with respect to said lip means of said body section.

2. The corner beading cleaner as defined in claim 1 wherein said securement means includes:

(a) a clamping plate extending laterally across said lip means of said body section and adapted to receive said tool means between said clamping plate and said lip means to fixedly hold said tool means in place with respect to said body section when said clamping plate is secured to said lip means; and (b) a thread member extending through said clamping plate to detachably secure said clamping plate and said tool means to said lip means, said lip means defining a threaded aperture mated to said threaded member and adapted to receive said threaded member therein to fixedly secure said clamping plate, said tool means and said lip means with respect to one another.

3. The corner beading cleaner as defined in claim 2 wherein said clamping plate includes a first ear means and a second ear means extending downwardly from the opposite lateral sides of said clamping plate to prevent lateral dislodgement of said tool means from between said clamping plate and said lip means.

4. The corner beading cleaner as defined in claim 1 wherein said lip means extends outwardly from said handle means at an angle of approximately 135 degrees.

5. The corner beading cleaner as defined in claim 1 wherein said two first blade means extend outwardly at an angle of 80 to 90 degrees with respect to one another.

6. The corner beading cleaner as defined in claim 1 wherein said two second blade means extend outwardly at an angle of 80 to 90 degrees with respect to one another.

7. The corner beading cleaner as defined in claim 1 wherein said handle means and said lip means are integral with respect to one another.

8. The corner beading cleaner as defined in claim 1 wherein said body section is aluminum.

9. The corner beading cleaner as defined in claim 1 wherein said tool means defines a first arcuate concave edge at the intersection between said first blade edges and a second arcuate concave edge at the intersection between said second blade edges.

10. A corner beading cleaner, being particularly adapted to shape hardened joint compound adjacent convex corner beadings, said corner beading cleaner comprising:

(a) a body section further including:

(1) a handle means adapted to be grasped by the user; and (2) a lip means extending outwardly from said handle means and being integral therewith, said lip means extending outwardly from said handle at an angle of approximately 135 degrees with respect thereto; and (b) a tool means detachably secured to said lip means of said body section, said tool means including two first blade edges extending outwardly therefrom at an angle of 80 to 90 degrees with respect to one another to form a cutting surface of 80 to 90 degrees, said tool means further including two second blade edges extending outwardly therefrom at an angle of 80 to 90 degrees with respect to one another to form a cutting surface of 80 to 90 degrees, said tool means defining a first arcuate concave edge at the intersection between said first blade edges and a second arcuate concave edge at the intersection between said second blade edges; and (c) a securement means adapted to detachably secure said tool means with respect to said lip means of said body section, said securement means further including;

(1) a clamping plate extending laterally across said lip means of said body section and adapted to receive said tool means between said clamping plate and said lip means to fixedly hold said tool means in place with respect to said body section when said clamping plate is secured to said lip means, said clamping means further including a first ear means and a second ear means extending downwardly from the opposite lateral sides of said clamping plate to prevent lateral dislodgement of said tool means from between said clamping plate and said lip means; and (2) a threaded member extending through said clamping plate to detachably secure said clamping plate and said tool means to said lip means, said lip means defining a threaded aperture mated to said threaded member and adapted to receive said threaded member therein to fixedly secure said clamping plate, said tool means and said lip means with respect to one another.

* * * * *